US008398387B2

(12) United States Patent
Shiotani et al.

(10) Patent No.: US 8,398,387 B2
(45) Date of Patent: Mar. 19, 2013

(54) FLUID MACHINE AND REFRIGERATION CYCLE APPARATUS

(75) Inventors: Yu Shiotani, Osaka (JP); Hiroshi Hasegawa, Osaka (JP); Takeshi Ogata, Osaka (JP); Shingo Oyagi, Osaka (JP); Masanobu Wada, Osaka (JP); Osamu Kosuda, Osaka (JP)

(73) Assignee: Panasonic Corporation, Osaka (JP)

( * ) Notice: Subject to any disclaimer, the term of this patent is extended or adjusted under 35 U.S.C. 154(b) by 616 days.

(21) Appl. No.: 12/670,231

(22) PCT Filed: May 21, 2009

(86) PCT No.: PCT/JP2009/002253

§ 371 (c)(1),
(2), (4) Date: Jan. 22, 2010

(87) PCT Pub. No.: WO2009/142023

PCT Pub. Date: Nov. 26, 2009

(65) Prior Publication Data

US 2010/0202909 A1 Aug. 12, 2010

(30) Foreign Application Priority Data

May 23, 2008 (JP) ..... 2008-135790

(51) Int. Cl.

| | |
|---|---|
| ***F01C 21/04*** | (2006.01) |
| ***F01C 21/06*** | (2006.01) |
| ***F03C 2/00*** | (2006.01) |
| ***F03C 4/00*** | (2006.01) |
| ***F04C 2/00*** | (2006.01) |
| ***F04C 4/00*** | (2006.01) |
| ***F04C 15/00*** | (2006.01) |
| ***F04C 27/02*** | (2006.01) |
| ***F04C 29/02*** | (2006.01) |
| ***F04C 29/04*** | (2006.01) |

(52) U.S. Cl. ..... 418/94; 418/5; 418/7; 418/55.1; 418/55.6; 418/89; 418/91; 418/98

(58) Field of Classification Search ..... 418/5, 7, 418/55.1, 55.6, 89, 91, 94, 98

See application file for complete search history.

(56) References Cited

U.S. PATENT DOCUMENTS 4,277,955 A * 7/1981 Parker ..... 62/510

(Continued)

FOREIGN PATENT DOCUMENTS

| | | |
|---|---|---|
| JP | 1-127865 | 5/1989 |
| JP | 6-046261 U | 6/1994 |
| JP | 7-035045 A | 2/1995 |
| JP | 2004-212006 | 7/2004 |

(Continued)

OTHER PUBLICATIONS

Specification, Claims, Abstract & Drawings from co-pending matter U.S. Appl. No. 12/670,213, filed Jan. 22, 2010, 27 pages.

*Primary Examiner* — Kenneth Bomberg
*Assistant Examiner* — Dapinder Singh
(74) *Attorney, Agent, or Firm* — Hamre, Schumann, Mueller & Larson, P.C.

(57) ABSTRACT

A fluid machine (101) includes a first compressor (107) and a second compressor (108). The first compressor (107) has a first closed casing (111), a first compression mechanism (102*a*), an expansion mechanism (104), and a shaft (113). A first oil reservoir (112) is formed in the first closed casing (111). The second compressor (108) has a second closed casing (125) and a second compression mechanism (102*b*). A second oil reservoir (126) is formed at a bottom portion in the second closed casing (125). The first closed casing (111) and the second closed casing (125) are connected to each other by an oil passage (109) so that a lubricating oil can flow between the first oil reservoir (112) and the second oil reservoir (126). An opening (109*a*) of the oil passage (109) on a side of the first closed casing (111) is located above the expansion mechanism (104) with respect to the vertical direction. This configuration prevents the low temperature lubricating oil in a surrounding space of the expansion mechanism (104) and the high temperature lubricating oil in the second compressor (108) from flowing. Thereby, the heat transfer between the first compressor (107) and the second compressor (108) is suppressed.

18 Claims, 10 Drawing Sheets

U.S. PATENT DOCUMENTS

| | | | | |
|---|---|---|---|---|
| 4,383,802 | A * | 5/1983 | Gianni et al. | 417/12 |
| 2005/0183447 | A1 | 8/2005 | Matsumoto et al. | |
| 2006/0059929 | A1 | 3/2006 | Sakitani et al. | |
| 2007/0074534 | A1 | 4/2007 | Sato | |
| 2008/0163642 | A1 | 7/2008 | Okamoto et al. | |
| 2009/0064709 | A1 * | 3/2009 | Sekiya et al. | 62/498 |
| 2009/0139262 | A1 | 6/2009 | Takahashi et al. | |

FOREIGN PATENT DOCUMENTS

| | | | |
|---|---|---|---|
| JP | 2007-170765 | A | 7/2007 |
| JP | 2008-038915 | A | 2/2008 |
| JP | 2008-107049 | A | 5/2008 |
| JP | 2008-116153 | | 5/2008 |
| WO | 2006/098165 | | 9/2006 |

* cited by examiner

FLUID MACHINE AND REFRIGERATION CYCLE APPARATUS

TECHNICAL FIELD

The present invention relates to a fluid machine and a refrigeration cycle apparatus.

BACKGROUND ART

Large-capacity refrigeration cycle apparatuses require a large-capacity compressor. Patent literature 1 discloses a method for increasing the capacity of a refrigeration cycle apparatus by connecting a plurality of compressors in parallel. FIG. 9 shows a compressor disclosed in the patent literature 1.

As shown in FIG. 9, a connected compressor 700 includes a first compressor 701*a* and a second compressor 701*b*. An upper portion of the first compressor 701*a* and an upper portion of the second compressor 701*b* are connected to each other by a pressure equalizing pipe 707. A bottom portion of the first compressor 701*a* and a bottom portion of the second compressor 701*b* are connected to each other by an oil equalizing pipe 708. Since a lubricating oil can flow from the first compressor 701*a* to the second compressor 701*b* and vice versa through the oil equalizing pipe 708, the amount of lubricating oil does not become excessive or deficient in each of these compressors.

In the meantime, research and development have been conducted actively on energy saving for refrigeration cycle apparatuses for water heaters and air conditioners. As one of the technologies for energy saving, expander-integrated compressors are being developed. The expander-integrated compressor is a fluid machine in which a compressor and an expander are coupled to each other by a shaft. FIG. 10 shows an expander-integrated compressor disclosed in patent literature 2.

As shown in FIG. 10, an expander-integrated compressor 800 includes a closed casing 802, a compression mechanism 801 disposed at an upper portion in the closed casing 802, and an expansion mechanism 804 disposed at a lower part in the closed casing 802. The compression mechanism 801 and the expansion mechanism 804 are coupled to each other by a first shaft 803 and a second shaft 805. An oil pump 808 for supplying a lubricating oil to the compression mechanism 801 is provided between the compression mechanism 801 and the expansion mechanism 804. The power recovered from a refrigerant at the expansion mechanism 804 is transferred to the compression mechanism 801 via the shafts 803 and 805. Thereby, the load on a motor for driving the compression mechanism 801 can be reduced.

Citation List

Patent Literature

PTL 1: JP 7(1995)-35045 A

PTL 2: JP 2008-38915 A

SUMMARY OF INVENTION

Technical Problem

The present inventors studied the possibility of using the expander-integrated compressor 800 shown in FIG. 10 as the first compressor 701*a* shown in FIG. 9. As a result, they found the following problems.

In the expander-integrated compressor 800 shown in FIG. 10, the expansion mechanism 804, which has a low temperature during operation, is disposed at the lower part in the closed casing 802, so the lubricating oil filling a surrounding space of the expansion mechanism 804 has a relatively low temperature. On the other hand, in the second compressor 701*b* shown in FIG. 9, the lubricating oil held in the casing has a relatively high temperature. Thus, when the second compressor 701*b* shown in FIG. 9 and the expander-integrated compressor 800 shown in FIG. 10 are coupled to each other by an oil equalizing pipe, heat may be transferred from the second compressor 701*b* to the expander-integrated compressor 800 via the lubricating oil. Such a heat transfer is not preferable because it lowers the temperature of the discharge refrigerant from the second compressor 701*b* and raises the temperature of the discharge refrigerant from the expansion mechanism 804.

The present invention is intended to suppress the heat transfer between a first compressor and a second compressor in a refrigeration cycle apparatus using an expander-integrated compressor as the first compressor.

Solution to Problem

The present invention provides a fluid machine including:

a first compressor having a first closed casing, a first compression mechanism disposed in the first closed casing, an expansion mechanism disposed in the first closed casing in such a manner that the expansion mechanism is located below the first compression mechanism with respect to a vertical direction, and a shaft coupling the first compression mechanism to the expansion mechanism, the first closed casing having a first oil reservoir formed therein in such a manner that a surrounding space of the expansion mechanism is filled with a lubricating oil for the first compression mechanism and the expansion mechanism;

a second compressor having a second closed casing and a second compression mechanism disposed in the second closed casing, the second closed casing having a second oil reservoir formed at a bottom portion thereof in such a manner that the lubricating oil for the second compression mechanism is held therein, and the second compression mechanism being connected in parallel to the first compression mechanism; and an oil passage having, on a side of the first closed casing, an opening located above the expansion mechanism with respect to the vertical direction, the oil passage connecting the first closed casing to the second closed casing so that the lubricating oil can flow between the first oil reservoir and the second oil reservoir.

In another aspect, the present invention provides a refrigeration cycle apparatus including:

a compressor for compressing a working fluid;

a radiator for cooling the working fluid compressed by the compressor;

an expander for expanding the working fluid cooled by the radiator; and an evaporator for evaporating the working fluid expanded by the expander.

The fluid machine is used as the compressor and the expander.

Advantageous Effects of Invention

When the first compressor is being operated, the lubricating oil filling the surrounding space of the expansion mechanism has a relatively low temperature. However, since the compression mechanism is disposed above the expansion mechanism, the lubricating oil held above the expansion mechanism has a higher temperature than that of the lubricating oil held in the surrounding space of the expansion mechanism.

In the present invention, the opening of the oil passage on the side of the first closed casing (on the side of the first compressor) is located above the expansion mechanism with respect to the vertical direction. Thus, the high temperature lubricating oil held above the expansion mechanism moves to the second compressor. Or the high temperature lubricating oil in the second compressor moves to a region above the expansion mechanism. In short, it is possible to prevent the low temperature lubricating oil in the surrounding space of the expansion mechanism from moving to the second compressor and to prevent the high temperature lubricating oil in the second compressor from moving to the surrounding space of the expansion mechanism as much as possible. As a result, the heat transfer between the first compressor and the second compressor can be suppressed.

DESCRIPTION OF EMBODIMENTS

Hereinafter, embodiments of the present invention will be described with reference to the drawings. The present invention is not limited to the following embodiments.

<Embodiment 1>

Figure 1:
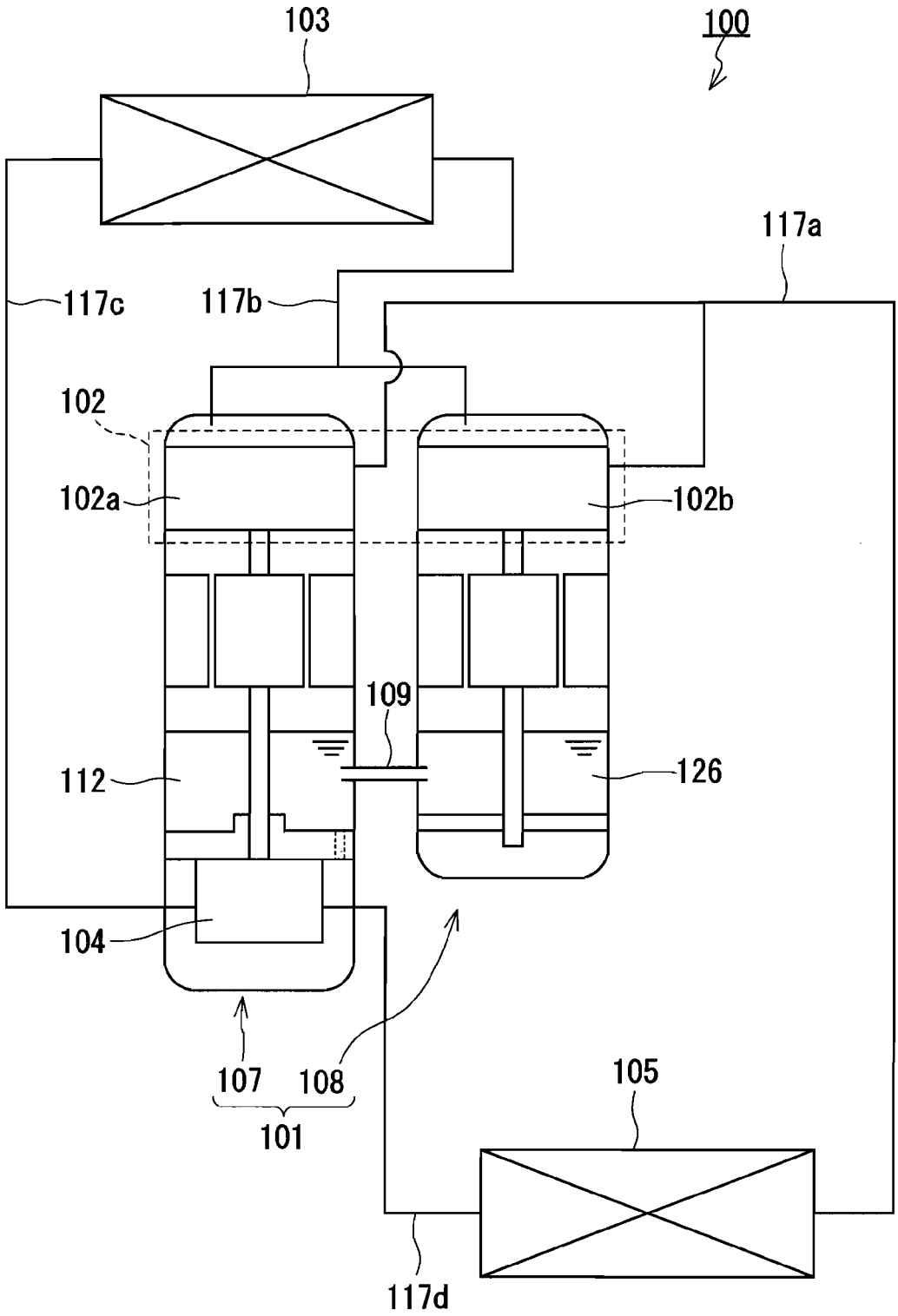
FIG. 1 is a configuration diagram of a refrigeration cycle apparatus according to Embodiment 1 of the present invention.

FIG. 1 is a configuration diagram of a refrigeration cycle apparatus 100 according to Embodiment 1 of the present invention. The refrigeration cycle apparatus 100 includes a fluid machine 101, a radiator 103, an evaporator 105, and pipes 117*a* to 117*d*. The fluid machine 101 plays a role of compressing and expanding a refrigerant serving as a working fluid. The radiator 103 cools the refrigerant compressed by a compression mechanism of the fluid machine 101. The evaporator 105 evaporates the refrigerant expanded by an expansion mechanism of the fluid machine 101. The fluid machine 101, the radiator 103, and the evaporator 105 are coupled to each other by the pipes 117*a* to 117*d*, forming a refrigerant circuit.

The fluid machine 101 is constituted by a first compressor 107 (an expander-integrated compressor), a second compressor 108 combined with the first compressor 107, and an oil passage 109 connecting the first compressor 107 to the second compressor 108. The oil passage 109 keeps a balance between the amount of the lubricating oil in the first compressor 107 and that in the second compressor 108. Since openings of the oil passage 109 are located in the vicinities of oil levels, the high temperature lubricating oil near the oil levels flows from the first compressor 107 to the second compressor 108 and vice versa. This prevents the heat transfer from a compression mechanism 102*b* of the second compressor 108 to an expansion mechanism 104 of the first compressor 107.

A compressor part 102 is composed of a compression mechanism 102*a* of the first compressor 107 and the compression mechanism 102*b* of the second compressor 108. In the refrigeration cycle apparatus 100, the compression mechanism 102*a* is connected to the compression mechanism 102*b* in parallel. Specifically, branched portions of the pipe 117*a* are connected to a suction port of the compression mechanism 102*a* and a suction port of the compression mechanism 102*b*, respectively. Thereby, the refrigerant flowing out of the evaporator 105 can be guided to both of the compression mechanism 102*a* and the compression mechanism 102*b*. Branched portions of the pipe 117*b* are inserted into a closed casing of the first compressor 107 and a closed casing of the second compressor 108, respectively. Thereby, the refrigerant compressed by the compression mechanism 102*a* and the refrigerant compressed by the compression mechanism 102*b* are merged with each other in the pipe 117*b* and guided to the radiator 103. The refrigerant cooled by the radiator 103 is expanded by the expansion mechanism 104 of the first compressor 107. The expanded refrigerant is sent to the evaporator 105.

The refrigerant circuit of the refrigeration cycle apparatus 100 is filled with the refrigerant that reaches a supercritical state in a high-pressure portion (a portion from the compressor part 102 to the expansion mechanism 104). A specific example of such a refrigerant is carbon dioxide. However, the refrigerant is not particularly limited to carbon dioxide, and it may be a refrigerant that does not reach the supercritical state in the refrigerant circuit. A fluorine refrigerant, such as hydrofluorocarbon, may be used as the refrigerant.

In the refrigeration cycle apparatus using carbon dioxide as the refrigerant, the difference between high pressure and low pressure in the cycle significantly is larger than in the refrigeration cycle apparatus using the fluorine refrigerant. Thus, when carbon dioxide is used as the refrigerant, the power recovery efficiency in the expansion mechanism 104 is excellent and the efficiency of the refrigeration cycle apparatus 100 is enhanced highly effectively. However, the large difference between high pressure and low pressure in the cycle may increase the range of fluctuation in the oil levels. In this case, the effect obtained by providing the oil passage 109 is high.

In the refrigeration cycle apparatus 100 of the present embodiment, the flowing direction of the refrigerant is fixed. However, the refrigeration cycle apparatus 100 may be provided with a passage (pipe) and a direction switching valve that make it possible to alter the flowing direction of the refrigerant. Furthermore, the refrigerant circuit may be provided with a distributing valve so as to stop the second compressor 108 and operate the first compressor 107 only.

Figure 2:
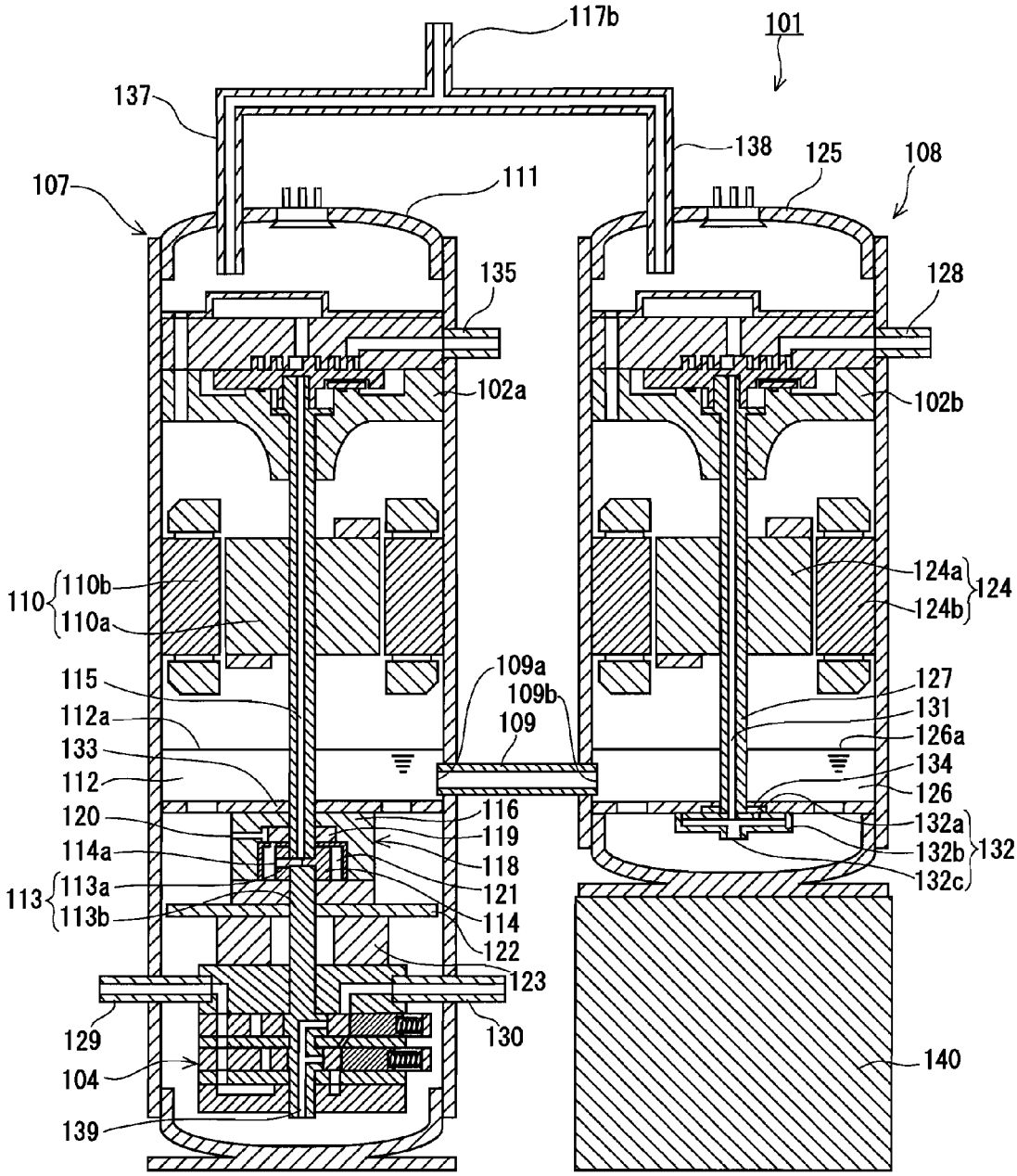
FIG. 2 is a cross-sectional view of a fluid machine according to the Embodiment 1 of the present invention.

FIG. 2 is a cross-sectional view of the fluid machine 101 shown in FIG. 1. The first compressor 107 includes a first closed casing 111, the first compression mechanism 102*a*, the expansion mechanism 104, a first motor 110 and a first shaft 113. The first compression mechanism 102*a* is disposed at an upper portion in the first closed casing 111. The expansion mechanism 104 is disposed at a lower portion in the first closed casing 111. The first motor 110 is disposed between the first compression mechanism 102*a* and the expansion mechanism 104. The first shaft 113 joins the first compression mechanism 102*a*, the expansion mechanism 104, and the first motor 110. A first oil reservoir 112 is formed in the first closed casing 111 in such a manner that a surrounding space of the expansion mechanism 104 is filled with the lubricating oil for the first compression mechanism 102*a* and the expansion mechanism 104. In the present embodiment, the fluid machine 101 is designed so that an axial direction of the first shaft 113 is parallel to the vertical direction.

The first closed casing 111 has a substantially cylindrical shape. The first closed casing 111 has a downwardly-protruded bottom portion formed into a so-called bowl shape. A lower side portion of the first closed casing 111 is utilized as the first oil reservoir 112.

The first motor 110 is an element for driving the first compression mechanism 102*a*, and includes a stator 110*b* fixed to an inner wall of the first closed casing 111 and a rotor 110*a* disposed inside the stator 110*b*. The first shaft 113 extending in an up-and-down direction is fixed to the rotor 110*a*.

The first shaft 113 includes an upper shaft 113*a*, a lower shaft 113*b*, and a coupler 114. The upper shaft 113*a* is a portion connected to the first compression mechanism 102*a*, and the lower shaft 113*b* is a portion connected to the expansion mechanism 104. The upper shaft 113*a* and the lower shaft 113*b* are coupled to each other by the coupler 114 so that the power recovered by the expansion mechanism 104 is transferred to the first compression mechanism 102*a*. The upper shaft 113*a* and the lower shaft 113*b* may be coupled directly to each other by engagement. The upper shaft 113*a* and the lower shaft 113*b* may be coupled to each other via a gear so that the number of rotations of the upper shaft 113*a* is different from that of the lower shaft 113*b*. Or they may be coupled to each other via a clutch or a torque converter. A shaft made of a single component may be used instead of the upper shaft 113*a* and the lower shaft 113*b*.

In the upper shaft 113*a*, an oil supply passage 115 is formed to extend in the axial direction. The lubricating oil held in the first oil reservoir 112 is supplied to the first compression mechanism 102*a* via the oil supply passage 115. Likewise, an oil supply passage 139 is formed to extend in the lower shaft 113*b* in the axial direction. The lubricating oil held in the first oil reservoir 112 is supplied to the expansion mechanism 104 via the oil supply passage 139.

The first compression mechanism 102*a* is attached to an upper end portion of the upper shaft 113*a*. The first compression mechanism 102*a* is a positive displacement compression mechanism that draws, compresses, and discharges the refrigerant as the upper shaft 113*a* rotates. In the present embodiment, a scroll type compression mechanism is used as the first compression mechanism 102*a*. The specific structure of the compression mechanism is not limited in any way, and it may be another type of compression mechanism, such as a rotary type.

The expansion mechanism 104 is attached to a lower portion of the lower shaft 113*b*. The expansion mechanism 104 is a positive displacement compression mechanism that draws, compresses, and discharges the refrigerant. When the refrigerant expands in the expansion mechanism 104, the expansion energy thereof is transferred to the lower shaft 113*b* as a rotational driving force. This rotational driving force is transferred to the upper shaft 113*a* via the coupler 114 and assists the driving of the first shaft 113 (the upper shaft 113*a*) by the first motor 110. In the present embodiment, a two-stage rotary expansion mechanism is used as the expansion mechanism 104. However, the specific structure of the expansion mechanism is not limited in any way, and it may be another type of expansion mechanism, such as the scroll type and screw type.

The term "rotary type" is meant to include not only the "rolling piston type" and "sliding vane type" but also the "swing piston type" in which a piston and a vane are integrated with each other.

At an upper-side portion of the first closed casing 111, a suction pipe 135 for guiding the refrigerant to the first compression mechanism 102*a* and a discharge pipe 137 for guiding the compressed refrigerant to an outside of the first closed casing 111 are provided. The suction pipe 135 penetrates through a side wall of the first closed casing 111 and is connected directly to the first compression mechanism 102*a*. The refrigerant coming from the suction pipe 135 is drawn directly into the first compression mechanism 102*a* without passing through an internal space of the first closed casing 111. The discharge pipe 137 penetrates through an upper wall of the first closed casing 111 and opens toward the internal space of the first closed casing 111. The refrigerant compressed by the first compression mechanism 102*a* is discharged to the internal space of the first closed casing 111, flows through the internal space, and then is discharged to the outside via the discharge pipe 137.

At the lower-side portion of the first closed casing 111, a suction pipe 129 for guiding the refrigerant to the expansion mechanism 104, and a discharge pipe 130 for guiding the expanded refrigerant to the outside of the first closed casing 111 are provided. Both of the suction pipe 129 and the discharge pipe 130 penetrate through the side wall of the first closed casing 111 and are connected directly to the expansion mechanism 104. The refrigerant coming from the suction pipe 129 is drawn directly into the expansion mechanism 104 without passing through the internal space of the first closed casing 111. The expanded refrigerant is discharged directly to the outside of the first closed casing 111 through the discharge pipe 130.

Between the first motor 110 and the expansion mechanism 104, a sub bearing 133, a first oil pump 118, a flow suppressing member 122, and a spacer 123 are disposed in this order from a side of the first motor 110. The first oil pump 118 serving as a first oil supply mechanism is constituted by a pump main body 119 and a housing 116 accommodating the pump main body 119, and supplies the lubricating oil held in the first oil reservoir 112 to the first compression mechanism 102*a*. The pump main body 119 is attached to the first shaft 113 (the upper shaft 113*a*) and rotates together with the first shaft 113. As the first oil pump 118 of the present embodiment, a known positive displacement pump, such as a rotary pump and a trochoid pump (registered trademark), can be used.

In the housing 116, a suction port 120 opening to the first oil reservoir 112 and an oil chamber 121 are formed. The oil chamber 121 serves also as a space in which the coupler 114 is disposed. A lower portion of the upper shaft 113*a* and an upper portion of the lower shaft 113*b* are inserted into the housing 116 and both of them are fitted to the coupler 114. A portion of the upper shaft 113*a* above the first oil pump 118 is supported rotatably by the sub bearing 133. In the coupler 114, an oil supply port 114*a* for bringing the oil chamber 121 into communication with the oil supply passage 115 of the upper shaft 113*a* is formed in such a manner that the oil supply port 114*a* penetrates through the coupler 114 in a radial direction. The lubricating oil is sent from the suction port 120 to the oil chamber 121 in association with the rotation of the pump main body 119. Then, the lubricating oil is guided to the oil supply passage 115 through the supply port 114*a* and supplied to the first compression mechanism 102*a*.

The flow suppressing member 122 is provided between the first oil pump 118 and the expansion mechanism 104 in the first oil reservoir 112. The flow suppressing member 122 suppresses the flow of the lubricating oil in the up-and-down direction (the vertical direction), allowing the lubricating oil to form a stable thermal stratification in the first oil reservoir 112. More specifically, the lubricating oil with a relatively high temperature is held near an oil level 112*a*, and the lubricating oil with a relatively low temperature is held in the surrounding space of the expansion mechanism 104. This makes it possible to prevent the heat transfer from the first compression mechanism 102*a* to the expansion mechanism 104 via the lubricating oil.

The flow suppressing member 122 is composed of a circular plate with a diameter slightly smaller than an inner diameter of the first closed casing 111. In a central part of the flow suppressing member 122, a through hole for allowing the first shaft 113 (the lower shaft 113*b*) to penetrate therethrough is formed. The flow suppressing member 122 is disposed horizontally in the first oil reservoir 112. Between the inner wall of the first closed casing 111 and an outer circumferential surface of the flow suppressing member 122, a clearance (a flow passage) that allows the lubricating oil to pass therethrough is formed. The flow suppressing member 122 may have a through hole serving as a flow passage that allows the lubricating oil to pass therethrough.

The spacer 123 is provided under the flow suppressing member 122. The spacer 123 forms a space that can hold the lubricating oil between the expansion mechanism 104 and the flow suppressing member 122. More specifically, the spacer 123 contributes to the formation of the stable thermal stratification, and as a result, contributes to the prevention of the heat transfer from the first compression mechanism 102*a* to the expansion mechanism 104.

A plurality of the flow suppressing members 122 may be provided with respect to the axial direction of the first shaft 113. For example, the sub bearing 133 may function as a second flow suppressing member. Furthermore, the flow suppressing member 122 may be integrated with the spacer 123, or the flow suppressing member 122 may be integrated with the housing 116 of the first oil pump 118.

The second compressor 108 includes a second closed casing 125, the second compression mechanism 102*b*, a second motor 124, and a second shaft 127. The second compression mechanism 102*b* is disposed at an upper portion in the second closed casing 125. The second shaft 127 couples the second compression mechanism 102*b* to the second motor 124. A second oil reservoir 126 is formed at a bottom portion of the second closed casing 125. The lubricating oil for the second compression mechanism 102*b* is held in the second oil reservoir 126. An axial direction of the second shaft 127 substantially is parallel to the vertical direction.

The second closed casing 125 has a substantially cylindrical shape. The bottom portion of the second closed casing 125 is downwardly-protruded into a so-called bowl shape. The bottom portion of the second closed casing 125 is utilized as the second oil reservoir 126. In the present embodiment, The second closed casing 125 has an inner diameter equal to that of the first closed casing 111.

The second motor 124 is an element for driving the second compression mechanism 102*b*, and includes a stator 124*b* fixed to an inner wall of the second closed casing 125 and a rotor 124*a* disposed inside the stator 124*b*. The second shaft 127 extending in the up-and-down direction is fixed to the rotor 124*a*.

In the second shaft 127, an oil supply passage 131 is formed to extend in the axial direction. The lubricating oil held in the second oil reservoir 126 is supplied to the second compression mechanism 102*b* through the oil supply passage 131.

The second compression mechanism 102*b* is attached to an upper end portion of the second shaft 127. The second compression mechanism 102*b* is a positive displacement compression mechanism that draws, compresses, and discharges the refrigerant as the second shaft 127 rotates. In the present embodiment, a scroll type compression mechanism is used as the second compression mechanism 102*b*. The specific structure of the compression mechanism is not limited in any way, and it may be another type of compression mechanism, such as a rotary type.

At an upper-side portion of the second closed casing 125, a suction pipe 128 for guiding the refrigerant to the second compression mechanism 102*b* and a discharge pipe 138 for guiding the compressed refrigerant to an outside of the second closed casing 125 are provided. The suction pipe 128 penetrates through a side wall of the second closed casing 125 and is connected directly to the second compression mechanism 102*b*. The refrigerant coming from the suction pipe 128 is drawn directly into the second compression mechanism 102*b* without passing through an internal space of the second closed casing 125. The discharge pipe 138 penetrates through an upper wall of the second closed casing 125 and opens toward the internal space of the second closed casing 125. The refrigerant compressed by the second compression mechanism 102*b* is discharged to the internal space of the second closed casing 125, flows through the internal space, and then is discharged to the outside via the discharge pipe 138.

A sub bearing 134 and a second oil pump 132 are disposed below the second motor 124. The second oil pump 132 serving as a second oil supply mechanism is constituted by a pump main body 132*a* and a cover 132*b* covering the pump main body 132*a*, and supplies the lubricating oil held in the second oil reservoir 126 to the second compression mechanism 102*b*. The pump main body 132*a* is attached to the second shaft 127 and rotates together with the second shaft 127. The cover 132*b* has a suction port 132*c*. A portion of the second shaft 127 above the second oil pump 132 is supported rotatably by the sub bearing 134. As the second oil pump 132 of the present embodiment, a positive displacement pump, such as a rotary pump and a trochoid pump (registered trademark), can be used. However, the specific structure of the second oil pump 132 is not particularly limited. For example, there may be used a structure in which the cover 132*b* is not provided and the suction port 132*c* is formed in a lower face of the pump main body 132*a*. A speed-type pump may be used instead of the positive displacement pump.

In the first compressor 107, the suction pipe 135 forms the branched portion of the pipe 117*a* shown in FIG. 1, and the discharge pipe 137 forms the branched portion of the pipe 117*b*. In the second compressor 108, the suction pipe 128 forms the branched portion of the pipe 117*a* shown in FIG. 1, and the discharge pipe 138 forms the branched portion of the pipe 117*b*. The discharge pipe 137 and the discharge pipe 138 are connected to each other outside of the first closed casing 111 and the second closed casing 125. The pipe 117*b* forms a pressure equalizing passage bringing the internal space of the first closed casing 111 into communication with the internal space of the second closed casing 125. Besides the pipe 117*b*, there may be provided another pipe bringing the internal space of the first closed casing 111 into communication with the internal space of the second closed casing 125 so as to allow the refrigerant to flow therebetween. Furthermore, the additional pipe may have a valve.

The oil passage 109 connects the first closed casing 111 to the second closed casing 125 so that the lubricating oil can flow from the first oil reservoir 112 to the second oil reservoir 126 and vice versa. One end of the oil passage 109 penetrates through the side wall of the first closed casing 111 and opens toward the first oil reservoir 112. Another end of the oil passage 109 penetrates through the side wall of the second closed casing 125 and opens toward the second oil reservoir 126. Hereinafter, one of the openings of the oil passage 109 on a side of the first closed casing 111 is referred to as a first opening 109*a*, and the other opening of the oil passage 109 on a side of the second closed casing 125 is referred to as a second opening 109*b*.

Typically, the oil passage 109 can be formed of a pipe. In the present embodiment, the oil passage 109 is formed of a straight circular pipe. In other words, the oil passage 109 extends straight and horizontal. However, the oil passage 109 does not necessarily have to be in a pipe shape. The first opening 109*a* is located at a height equal to that of the second opening 109*b* with respect to the axial direction, with an undersurface of the first closed casing 111 being used as a reference. However, the first opening 109*a* may be located at a height different from that of the second opening 109*b* with respect to the axial direction. The oil passage 109 may be bent between the first closed casing 111 and the second closed casing 125.

The first closed casing 111 and the second closed casing 125 are connected to each other by the discharge pipe 137 and the discharge pipe 138 (the pipe 117*b*). Thus, when one of the closed casings has a higher internal pressure than that of the other, the pressure difference serves as a driving force and allows the refrigerant to flow from the one closed casing to the other. This equalizes the internal pressure of the first closed casing 111 with that of the second closed casing 125. For example, when the first closed casing 111 has a higher internal pressure than that of the second closed casing 125, the high pressure refrigerant in the first closed casing 111 flows into the second closed casing 125 via the discharge pipe 137 and the discharge pipe 138.

The first oil reservoir 112 and the second oil reservoir 126 are connected to each other by the oil passage 109. Thus, when the oil level in one of the oil reservoirs is lowered, the lubricating oil flows therein from the other one. For example, when the amount of oil in the second oil reservoir 126 decreases, the lubricating oil in the first oil reservoir 112 flows into the second oil reservoir 126 via the oil passage 109. Accordingly, the oil level 112*a* in the first oil reservoir 112 is equalized with the oil level 126*a* in the second oil reservoir 126 with respect to the vertical direction.

In the first compressor 107, the expansion mechanism 104 completely is immersed in the lubricating oil held in the first oil reservoir 112. The oil level 112*a* is present above the sub bearing 133 with respect to the axial direction. When the refrigeration cycle apparatus 100 is being operated, the expansion mechanism 104 has a low temperature in association with the expansion of the refrigerant. Accordingly, the lubricating oil filling the surrounding space of the expansion mechanism 104 also has a low temperature. On the other hand, the lubricating oil near the oil level 112*a* has a relatively high temperature because the internal space of the first closed casing 111 is filled with the discharge refrigerant from the first compression mechanism 102*a*. Thus, the lubricating oil held in the first oil reservoir 112 has a relatively high temperature near the oil level 112*a* and a relatively low temperature in the surrounding space of the expansion mechanism 104.

In the second compressor 108, the lubricating oil near the oil level 126*a* has a relatively high temperature because the internal space of the second closed casing 125 is filled with the discharge refrigerant from the second compression mechanism 102*a*. The heat is transferred to the entire lubricating oil held in the second oil reservoir 126, and the entire lubricating oil in the second oil reservoir 126 has a relatively high temperature.

The first opening 109*a* of the oil passage 109 is located above the expansion mechanism 104 with respect to the vertical direction. Thereby, the lubricating oil present above the expansion mechanism 104 can flow into the oil passage 109. This means that the lubricating oil with a relatively high temperature flows preferentially between the first oil reservoir 112 and the second oil reservoir 126. As a result, it is possible to prevent the heat transfer from occurring between the expansion mechanism 104 of the first compressor 107 and the second compressor 108 via the lubricating oil.

In this specification, "being present/located above the expansion mechanism 104 with respect to the vertical direction" means to be present/located at least above an expansion chamber of the expansion mechanism 104. Preferably, it means to be located/present above the suction pipe 129 and the discharge pipe 130, both connected to the expansion mechanism 104.

The first opening 109*a* of the oil passage 109 is located above the flow suppressing member 122 with respect to the vertical direction. The lubricating oil held above the flow suppressing member 122 has a relatively high temperature. Thus, when the lubricating oil moves from the first oil reservoir 112 to the second oil reservoir 126 through the oil passage 109, the temperature of the lubricating oil in the second oil reservoir 126 hardly is lowered. Thereby, it is possible to prevent the temperature of the discharge refrigerant from the second compression mechanism 102*b* from being lowered. In the present embodiment, in order to enhance this effect further, the first opening 109*a* of the oil passage 109, the flow suppressing member 122, and the expansion mechanism 104 are arranged in this order from a top (from a side of the first compression mechanism 102*a*) with respect to the vertical direction.

Since the internal space of the first closed casing 111 is in communication with the internal space of the second closed casing 125 via the discharge pipe 137 and the discharge pipe 138 as described above, the internal pressures of both of the closed casings are equal during normal operation. However, at the time of transition at which the operational status changes significantly in both or in one of the first compression mechanism 102*a* and the second compression mechanism 102*b*, for example, at the time of start-up, one of the closed casings may have a significantly higher internal pressure than that of the other. In this case, a large amount of the lubricating oil flows from the high-pressure-side closed casing into the low-pressure-side closed casing via the oil passage 109, and the oil level of the oil reservoir in the high-pressure side closed casing temporarily is lowered significantly. On the other hand, the oil level of the oil reservoir in the low-pressure side closed casing temporarily is raised significantly.

In the present embodiment, the first opening 109*a* of the oil passage 109 is located above the suction port 120 of the first oil pump 118 with respect to the vertical direction. In such a configuration, the outflow of the lubricating oil from the first closed casing 111 to the second closed casing 125 stops when the oil level 112*a* in the first oil reservoir 112 is lowered to a lower end of the first opening 109*a* of the oil passage 109. More specifically, the oil level 112*a* cannot be lower than the lower end of the first opening 109*a*, and this cannot be lower than the suction port 120 of the first oil pump 118. Since the oil level 112*a* always is above the suction port 120 of the first oil pump 118, the first oil pump 118 stably can draw the lubricating oil even at the time of transition such as start-up. Accordingly, the lubricating oil stably is supplied to the first compression mechanism 102*a*, and thereby the reliability of the first compression mechanism 102*a* increases.

More preferably, the first opening 109*a* of the oil passage 109, the suction port 120 of the first oil pump 118, and the flow suppressing member 122 are arranged in this order from the top with respect to the axial direction of the first shaft 113. With such a configuration, each of the effects mentioned above can be attained.

In the present embodiment, the second opening 109*b* of the oil passage 109 is located above the suction port 132*c* of the second oil pump 132 with respect to the vertical direction. This configuration allows the second oil pump 132 to draw the lubricating oil in a reliable manner even when the second closed casing 125 temporarily has an internal pressure higher than that of the first closed casing 111. Accordingly, the lubricating oil stably is supplied to the second compression mechanism 102*b*, and thereby the reliability of the second compression mechanism 108 increases.

Moreover, in the present embodiment, the first opening 109*a* of the oil passage 109 is located below the rotor 110*a* of the first motor 110 and the second opening 109*b* of the oil passage 109 is located below the rotor 124*a* of the second motor 124, with respect to the vertical direction. This configuration can prevent each of the motors from being immersed in the lubricating oil. Specifically, a design made to satisfy the following relationships reliably can prevent the motors from being immersed in the lubricating oil.

Figure 3:
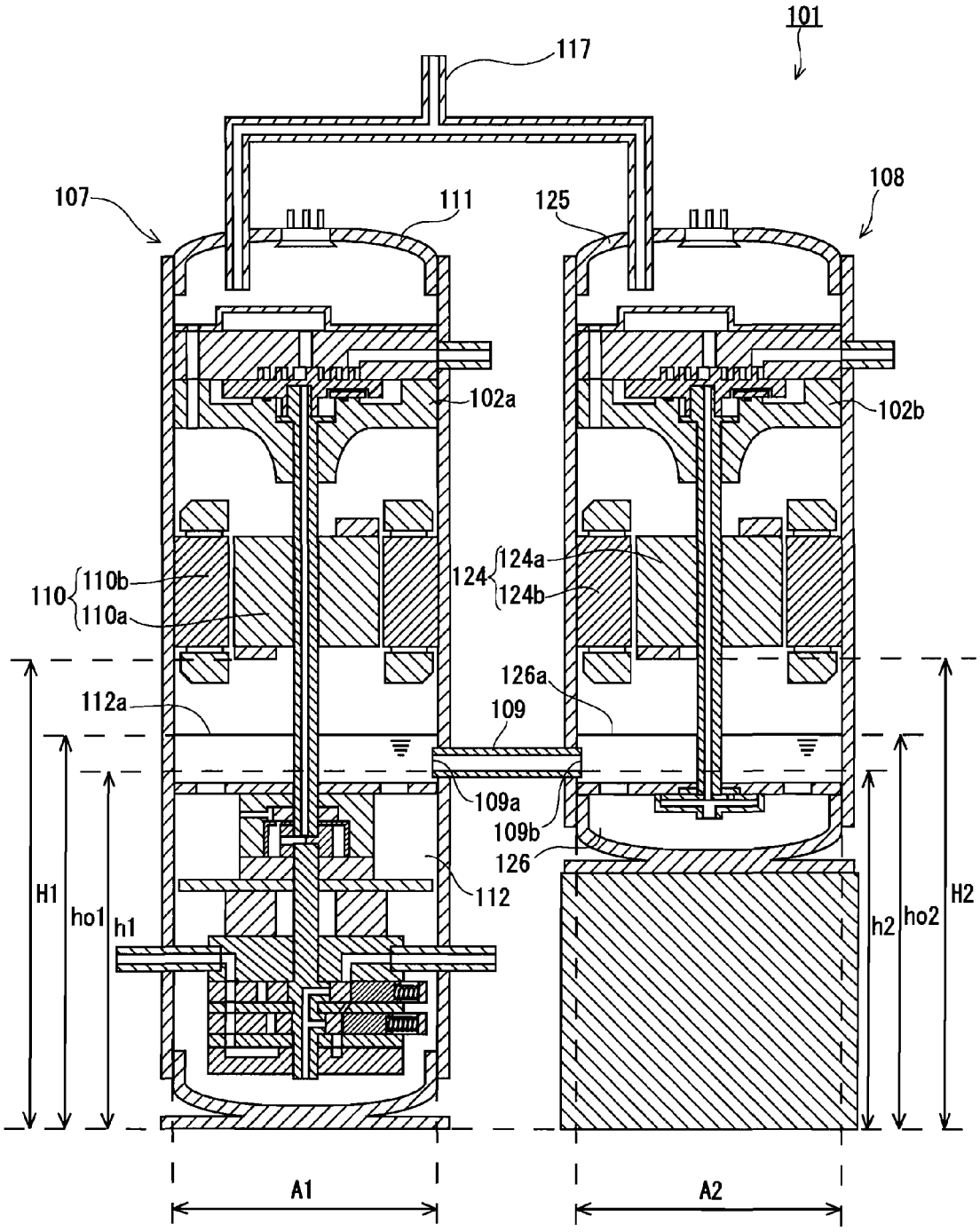
FIG. 3 is a view illustrating a relative positional relationship among an oil passage, an oil level, and a motor.

First, the undersurface of the first closed casing 111 is used as a reference with respect to the vertical direction as shown in FIG. 3. Definitions are made that when the refrigeration cycle apparatus 100 is not being operated, a height from the reference to the oil level 112*a* is ho1, a height from the reference to the oil level 126*a* is ho2, a height from the reference to a lower end of the rotor 110*a* of the first motor 110 is H1, a height from the reference to a lower end of the rotor 124*a* of the second motor 124 is H2, a height from the reference to the lower end of the first opening 109*a* is h1, a height from the reference to a lower end of the second opening 109*b* is h2, a cross-sectional area of the first closed casing 111 with respect to the horizontal direction is A1 (a cross-sectional area of the first oil reservoir 112), and a cross-sectional area of the second closed casing 125 (a cross-sectional area of the second oil reservoir 126) with respect to the horizontal direction is A2. Here, the position of the second opening 109*b* of the oil passage 109 is determined to satisfy the following formula (1).

$$ho1+(A2/A1)(ho2+h2)<H1 \quad (1)$$

The above-mentioned formula (1) means that even in the case where all of the lubricating oil present above the lower end of the second opening 109*b* has flown into the first oil reservoir 112, the oil level 112*a* always is present below the lower end of the rotor 110*a*. That is, even if a large amount of the lubricating oil flows from the second oil reservoir 126 into the first oil reservoir 112, the rotor 110*a* is not immersed in the lubricating oil.

When the refrigeration cycle apparatus 100 is being operated, the lubricating oil circulates through the refrigerant circuit together with the refrigerant. Thus, when the refrigeration cycle apparatus 100 is being operated, the amounts of the oil held in the first oil reservoir 112 and the second oil reservoir 126 surely are less than those when the refrigeration cycle apparatus 100 is not being operated. In the case where the formula (1) is satisfied when the refrigeration cycle apparatus 100 is not being operated, the relationship ho1<H1 holds definitely also when the refrigeration cycle apparatus 100 is being operated. This makes it possible to avoid an increase in load on the first motor 110 due to immersion of the rotor 110*a* in the lubricating oil. As a result, it is possible to prevent an increase in power consumption by the first compressor 107 and deterioration in performance of the refrigeration cycle apparatus 100.

Furthermore, as in the case of the second opening 109*b*, the position of the first opening 109*a* of the oil passage 109 is defined to satisfy the following formula (2).

$$ho2+(A1/A2)(ho1+h1)<H2 \quad (2)$$

In the case where the formula (2) is satisfied when the refrigeration cycle apparatus 100 is not being operated, the relationship ho2<H2 holds definitely even when a large amount of the lubricating oil flows from the first oil reservoir 112 into the second oil reservoir 126. This makes it possible to avoid an increase in load on the second motor 124 due to immersion of the rotor 124*a* in the lubricating oil. As a result, it is possible to prevent an increase in power consumption by the second compressor 108 and deterioration in performance of the refrigeration cycle apparatus 100.

In the present embodiment, the first opening 109*a* is located at a height equal to that of the second opening 109*b* with respect to the vertical direction. This configuration allows the lubricating oil to be transferred smoothly between the first oil reservoir 112 and the second oil reservoir 126.

In the present embodiment, the oil passage 109 is formed of a straight pipe. This configuration makes it possible to suppress the pressure loss generated when the lubricating oil flows through the oil passage 109. Moreover, since this configuration makes it possible to connect the first closed casing 111 to the second closed casing 125 with the shortest distance therebetween, the amount of heat that the lubricating oil loses in the oil passage 109 can be minimized.

In the present embodiment, the first compressor 107 is configured so that the refrigerant compressed by the first compression mechanism 102*a* is discharged to the outside of the first closed casing 111 via the internal space of the first closed casing 111. The second compressor 108 is configured so that the refrigerant compressed by the second compression mechanism 102*b* is discharged to the outside of the second closed casing 125 via the internal space of the second closed casing 125. The pressure equalizing passage that brings the internal space of the first closed casing 111 into communication with the internal space of the second closed casing 125 is provided. Specifically, the pressure equalizing passage is formed of the pipe 117*b* having, as branched portions, the discharge pipe 137 and the discharge pipe 138. Since the internal pressures of both of the closed casings are kept almost the same, the pressures acting on the oil level 112*a* and the oil level 126*a* also are almost the same. The pipe 117*b* and the oil passage 109 function to keep the oil level 112*a* and the oil level 126*a* at almost the same height. This makes it easy to control the oil levels in the first compressor 107 and the second compressor 108. No other special means (such as an oil level sensor) for controlling the oil levels is needed, which is advantageous in reducing the production cost and parts count.

In the present embodiment, the suction port 120 of the first oil pump 118 is located at a height equal to that of the suction port 132*c* of the second oil pump 132 with respect to the vertical direction. When the oil level 112*a* in the first oil reservoir 112 is above the suction port 120 of the first oil pump 118, the oil level 126*a* in the second oil reservoir 126 also is above the suction port 132*c* of the second oil pump 132. The opposite to this also holds. Thus, it is easy to control the oil levels, and it is possible to supply the lubricating oil to each of the compression mechanisms. This enhances the reliabilities of the first compression mechanism 102*a* and the second compression mechanism 102*b*.

As shown in FIG. 2, the first closed casing 111 is longer than the second closed casing 125 in the vertical direction in order to accommodate the first compression mechanism 102*a* and the expansion mechanism 104. Furthermore, the first oil pump 118 is disposed between the expansion mechanism 104 and the first compression mechanism 102*a*. Thus, the suction port 120 of the first oil pump 118 is located near a center of the first closed casing 111 with respect to the vertical direction. In contrast, in the second compressor 108, the suction port 132*c* of the second oil pump 132 is located near the bottom portion of the second closed casing 125. In order to equalize a height from the reference position (the undersurface of the first closed casing 111) to the suction port 120 of the first oil pump 118 with a height from the reference position to the suction port 132*c* of the second oil pump 132, a height adjustment is needed on the second compressor 108 side. However, it is not preferable to elongate the second closed casing 125 from the viewpoint of suppressing the heat radiation loss. Thus, in the present embodiment, there is provided, below the second closed casing 125, a bottom raising member 140 for complementing a height of the second closed casing 125 to a height of the first closed casing 111. By doing so, an existing compressor can be used as the second compressor 108 without changing its design, suppressing the production and development costs.

As the bottom raising member 140, a structure, such as a housing, a supporting leg, and a strut, can be used. This structure may be made of metal or resin. The radiator 103 shown in FIG. 1 may be used as the bottom raising member 140.

In the present embodiment, the first compression mechanism 102*a* is a scroll compression mechanism. The scroll compression mechanism is excellent as the first compression mechanism 102*a* to be disposed above the oil level 112*a* because it is easy to supply the oil to the scroll compression mechanism. The first compression mechanism 102*a*, which is a high temperature heat source, is disposed at an upper part, and the expansion mechanism 104, which is a low temperature heat source, is disposed at a lower part in the first compressor 107. In this layout, the high temperature, low density lubricating oil occupies the vicinity of the oil level 112*a*, and the low temperature, high density lubricating oil fills the surrounding space of the expansion mechanism 104, so natural convection hardly occurs. That is, the high temperature lubricating oil and the low temperature lubricating oil hardly are mixed with each other, and thereby it is possible to suppress the heat transfer between the first compression mechanism 102*a* and the expansion mechanism 104 and to suppress a decrease in temperature of the discharge refrigerant from the first compressor 107. As a result, the efficiency of the refrigeration cycle apparatus 100 can be increased.

In the present embodiment, the expansion mechanism 104 is a two-stage rotary expansion mechanism. Generally, it is desired that the rotary fluid mechanism be immersed in the lubricating oil entirely in order to keep the sealability and lubricity thereof. More specifically, the oil needs to be supplied to its shaft and vane. In the present embodiment, the expansion mechanism 104 is disposed at the lower portion in the first closed casing 111 and immersed in the oil held in the first oil reservoir 112. Thereby, the oil can be supplied to the expansion mechanism 104 reliably and easily, and the expansion mechanism 104 can be operated highly efficiently. As a result, the efficiency of the refrigeration cycle apparatus 100 can be increased.

MODIFIED EXAMPLE 1

Figure 4:
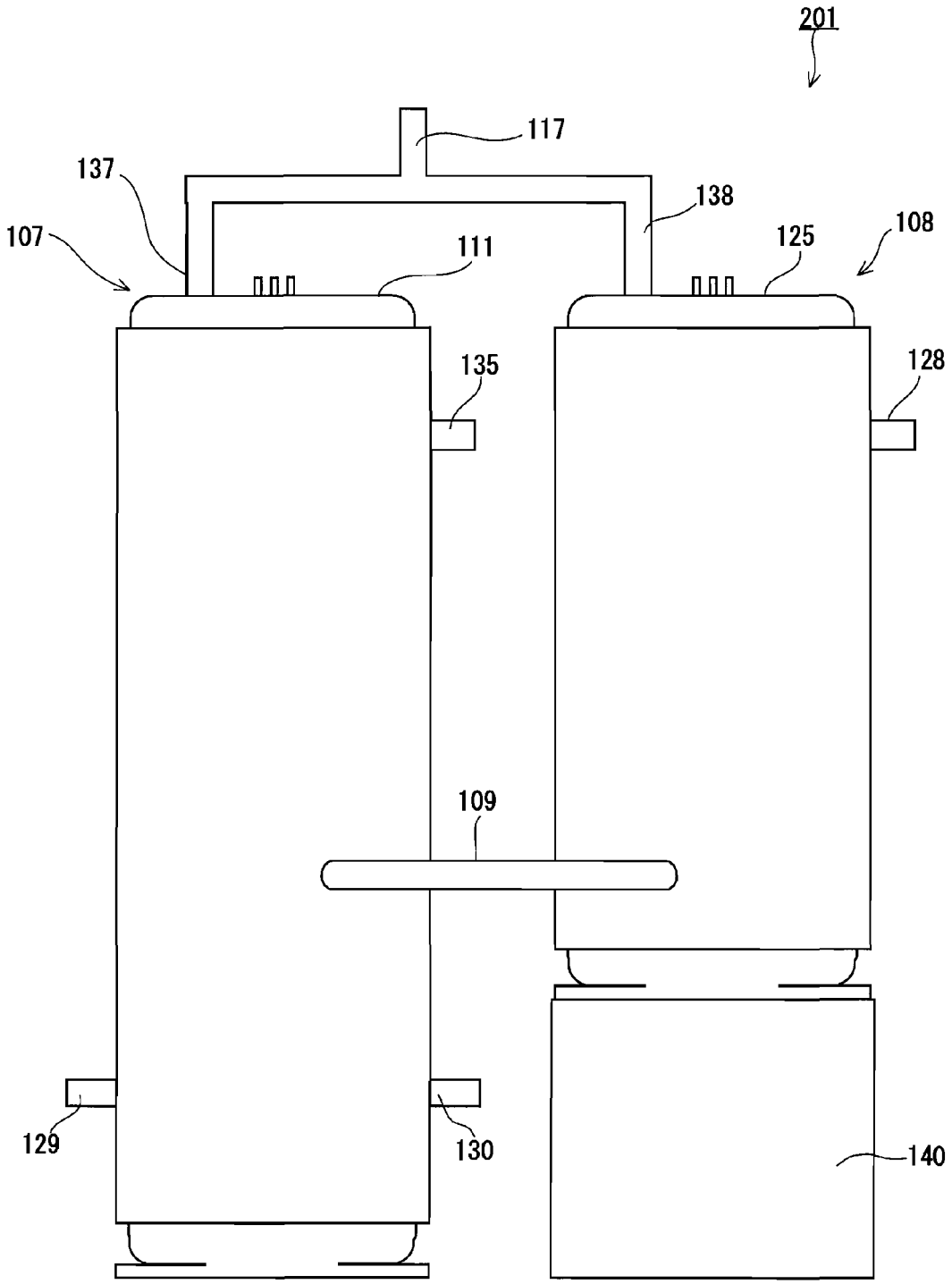
FIG. 4 is a side view of a fluid machine according to a modified example.
Figure 5:
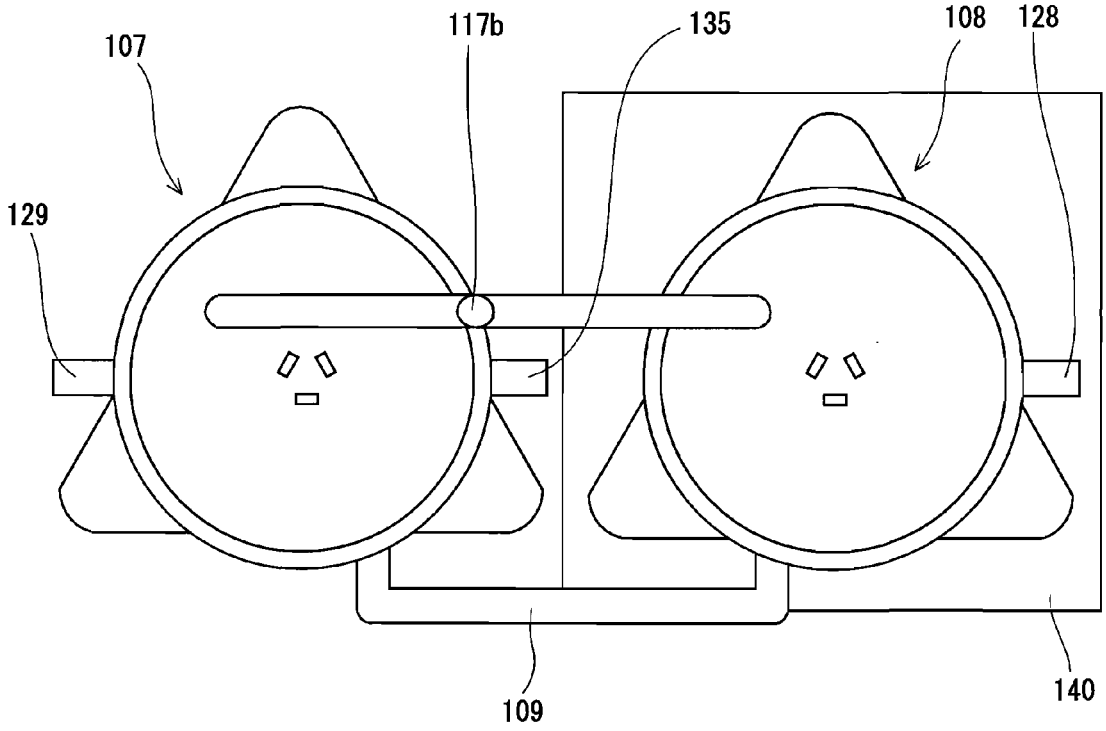
FIG. 5 is a top view of the fluid machine shown in FIG. 4.

As shown in FIG. 4 and FIG. 5, in a fluid machine 201 of the present modified example, the oil passage 109 is formed of a U-shaped bent pipe. The bent pipe is inserted into each of the first closed casing 111 and the second closed casing 125 from the same direction with respect to the horizontal direction. In this configuration, when a work (soldering, for example) is performed to connect the bent pipe serving as the oil passage 109 to one of the other closed casings, a tool hardly interferes with the other closed casing. Moreover, since the work can be performed from the same direction, the working efficiency also is increased and the productivity is enhanced.

MODIFIED EXAMPLE 2

As described with reference to FIG. 2, when the first opening 109*a* of the oil passage 109 is located above the suction port 120 of the first oil pump 118 with respect to the vertical direction, there can be obtained an effect that the lubricating oil stably can be supplied to the first compression mechanism 102*a*. This effect can be obtained separately from the effect of preventing the heat transfer. Specifically, this effect can be obtained also when the positional relationship between the compression mechanism and the expansion mechanism is opposite to that in the first compressor 107 shown in FIG. 2.

Figure 6:
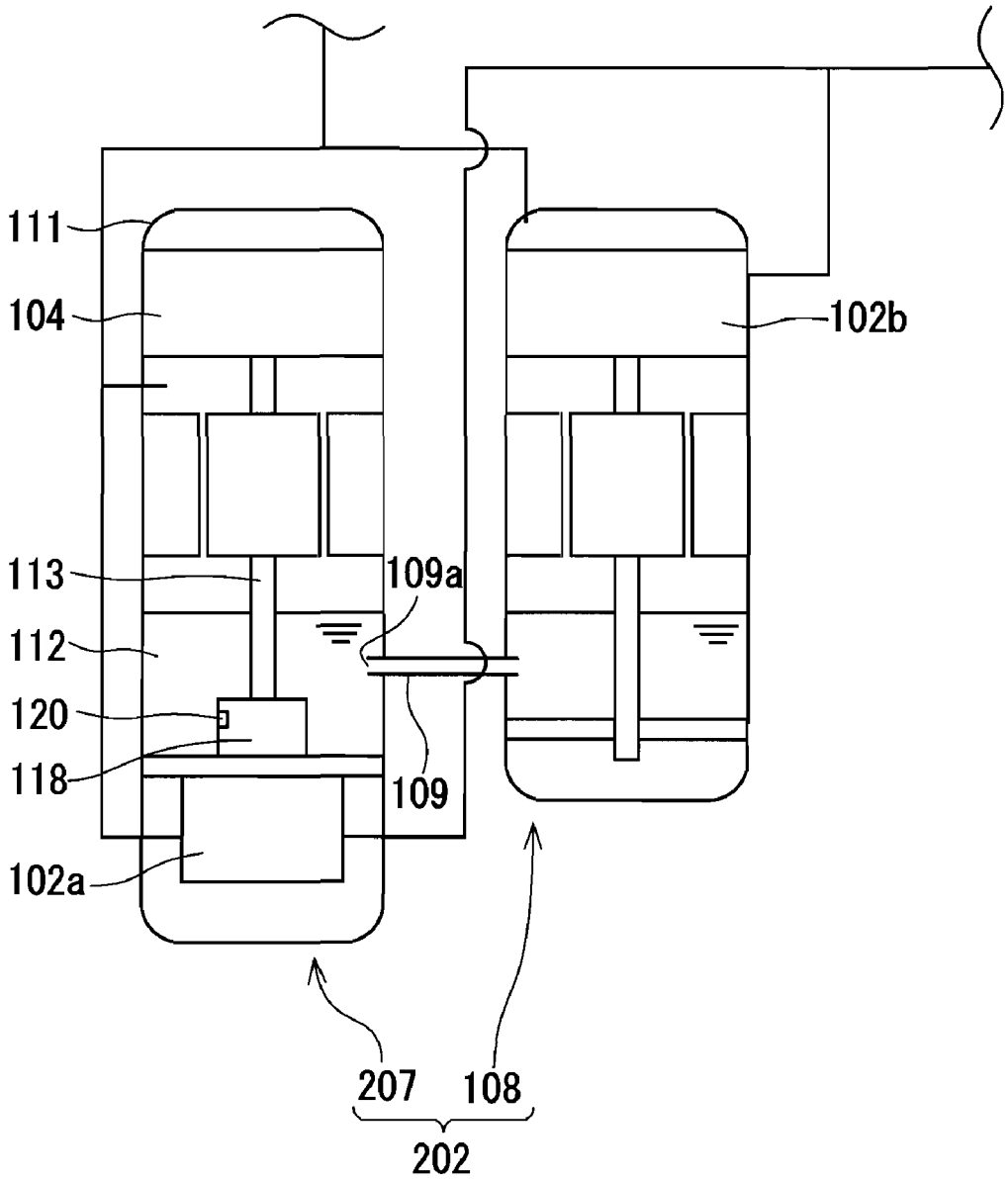
FIG. 6 is a schematic view of a fluid machine according to another modified example.

More specifically, a first compressor 207 (an expander-integrated compressor) of a fluid machine 202 shown in FIG. 6 includes (a) the first closed casing 111, (b) the expansion mechanism 104 disposed at the upper portion in the first closed casing 111, (c) the first compression mechanism 102*a* disposed at the lower portion in the first closed casing 111, (d) the shaft 113 coupling the expansion mechanism 104 to the first compression mechanism 102*a*, (e) the first oil reservoir 112 formed in the first closed casing 111 in such a manner that the surrounding space of the first compression mechanism 102*a* is filled with the lubricating oil, and (f) the first oil pump 118 (the first oil supply mechanism) that is for supplying the lubricating oil held in the first oil reservoir 112 to the expansion mechanism 104, and is disposed between the expansion mechanism 104 and the first compression mechanism 102*a*. Since the first opening 109*a* of the oil passage 109 is located above the suction port 120 of the first oil pump 118 with respect to the vertical direction (the axial direction), the first oil pump 118 stably can draw the lubricating oil even at the time of transition such as start-up.

Like the fluid machine shown in FIG. 2, the fluid machines of both of the modified examples also can be used suitably in the refrigeration cycle apparatus 100 shown in FIG. 1.

<Embodiment 2>

Figure 7:
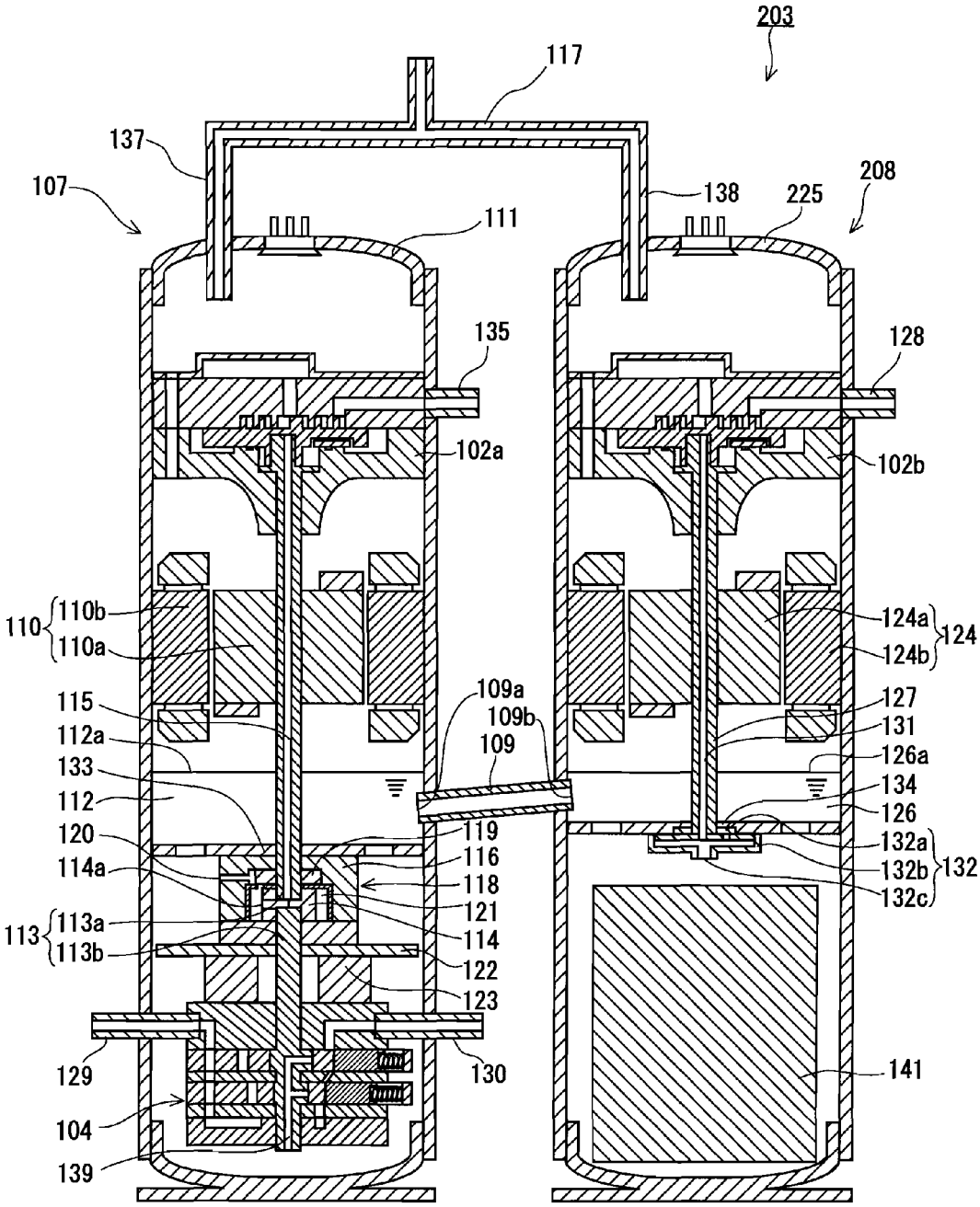
FIG. 7 is a cross-sectional view of a fluid machine according to Embodiment 2.

FIG. 7 is a cross-sectional view of a fluid machine according to Embodiment 2. The fluid machine 203 can be applied to the refrigeration cycle apparatus 100 (FIG. 1) instead of the fluid machine 101 described in the Embodiment 1. Hereinafter, the same reference numerals will be used for the same elements as those in the Embodiment 1, and explanations thereof will be omitted.

The fluid machine 203 is different from the fluid machine of the Embodiment 1 in that the fluid machine 203 includes a second compressor 208 having a vertically long second closed casing 225. The second closed casing 225 is elongated in the up-and-down direction more than closed casings used in general compressors. Specifically, the size of the second closed casing 225 is the same as that of the first closed casing 111 of the first compressor 107. With this configuration, a cost reduction effect is likely to be obtained by using the common component. Moreover, when the second oil reservoir 126 is provided with an oil excluding member 141, the amount of the lubricating oil to be filled and the heat radiation loss can be reduced.

In the fluid machine 203, the amount of the lubricating oil that is discharged from the first compressor 107 to the refrigerant circuit together with the refrigerant is larger than the amount of the lubricating oil that is discharged from the second compressor 208 to the refrigerant circuit. This is because the first compression mechanism 102*a* and the expansion mechanism 104 use the lubricating oil in the first compressor 107, but in the second compressor 208, only the second compression mechanism 102*b* uses the lubricating oil. Thus, the consumption speed of the lubricating oil in the first oil reservoir 112 is higher than that in the second oil reservoir 126. On the other hand, the amount of the lubricating oil that is separated from the refrigerant in the internal space of the first closed casing 111 and recovered into the first oil reservoir 112 is almost equal to the amount of the lubricating oil that is separated from the refrigerant in an internal space of the second closed casing 225 and recovered into the second oil reservoir 126, assuming that these compression mechanisms have almost the same volumetric capacity as each other. Thus, the amount of the lubricating oil held in the first oil reservoir 112 decreases easily during normal operation. The lubricating oil flows from the second oil reservoir 126 into the first oil reservoir 112 via the oil passage 109 so as to cancel the difference between the lubricating oil consumption speeds.

In the present embodiment, the first opening 109*a* of the oil passage 109 is set to a position below the second opening 109*b*. With such a configuration, a head of the lubricating oil near the first opening 109*a* is smaller than that of the lubricating oil near the second opening 109*b*, and thereby the lubricating oil moves smoothly from the second oil reservoir 126 to the first oil reservoir 112. As a result, shortage of the lubricating oil is prevented, enhancing the reliability of the first compressor 107.

The difference between the lubricating oil consumption speeds is remarkable in an operational status (at the time of start-up, for example) in which the lubricating oil is drawn and discharged in a larger quantity. In such an operational status, the amount of the lubricating oil discharged to the refrigerant circuit together with the refrigerant is larger than the amount of the lubricating oil separated and recovered from the discharge refrigerant. Thus, the oil level 112*a* in the first oil reservoir 112 and the oil level 126*a* in the second oil reservoir 126 are lowered temporarily. And the oil level 112*a* in the first oil reservoir 112 further may be lowered from that position.

In the present embodiment, the suction port 120 of the first oil pump 118 is located below the suction port 132*c* of the second oil pump 132 with respect to the vertical direction. Such a configuration allows the first oil pump 118 to continue drawing the lubricating oil via the suction port 120 even when the oil level 112*a* is lower than the oil level 126*a*. Thereby, shortage of the lubricating oil supply to the first compression mechanism 102*a* is prevented, enhancing the reliability of the first compressor 107.

<Embodiment 3>

Figure 8:
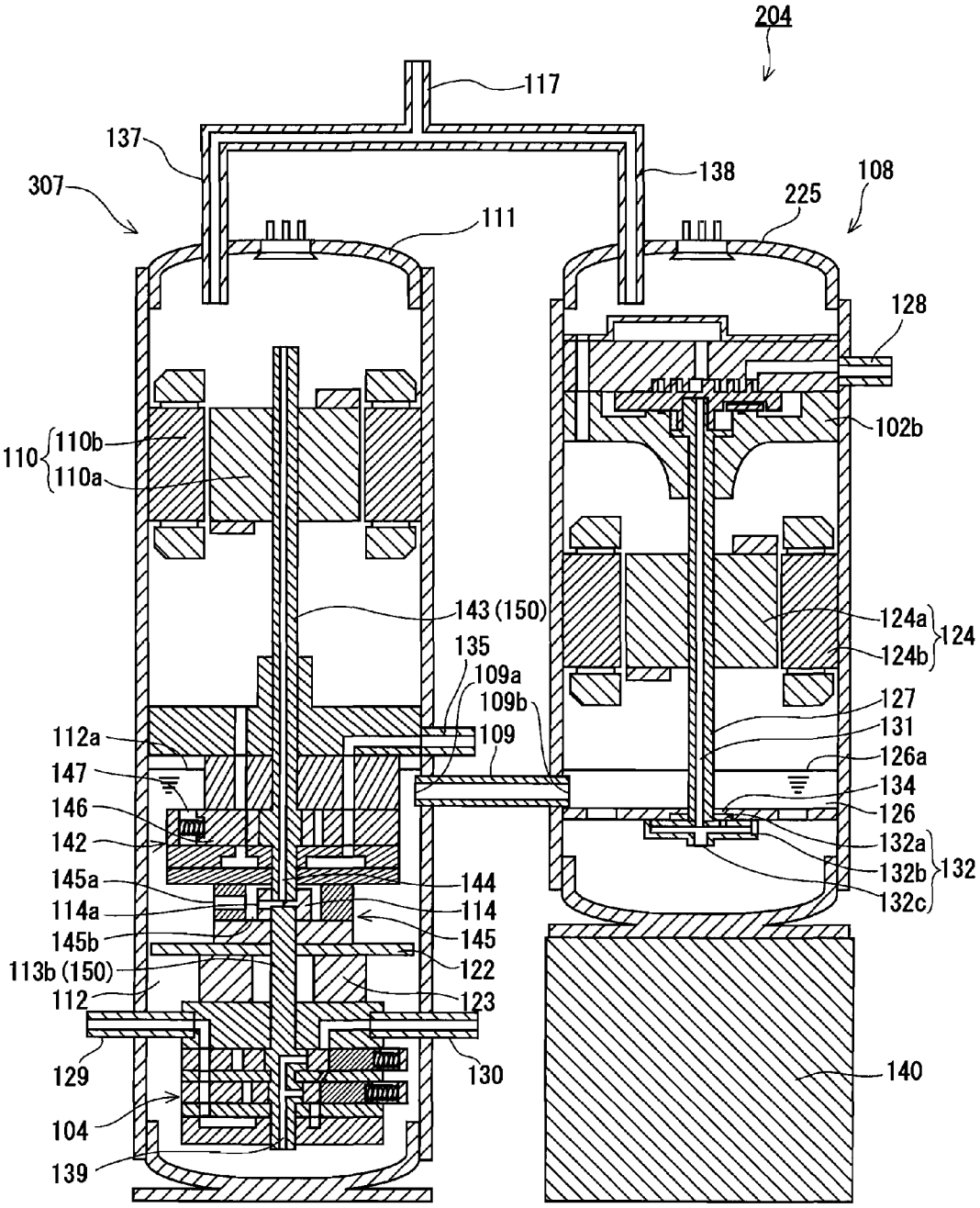
FIG. 8 is a cross-sectional view of the fluid machine according to Embodiment 3.
Figure 9:
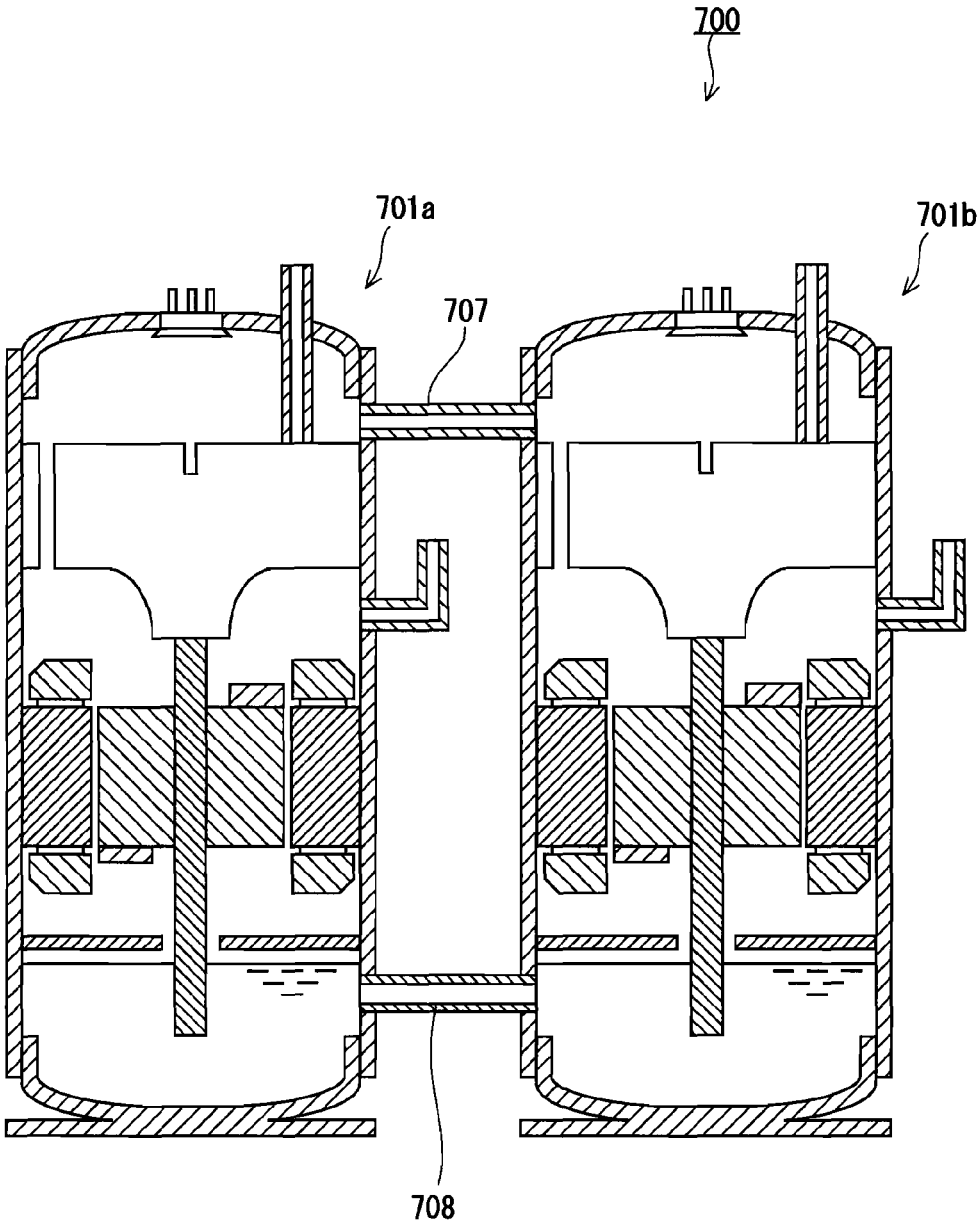
FIG. 9 is a cross-sectional view of a conventional compressor.
Figure 10:
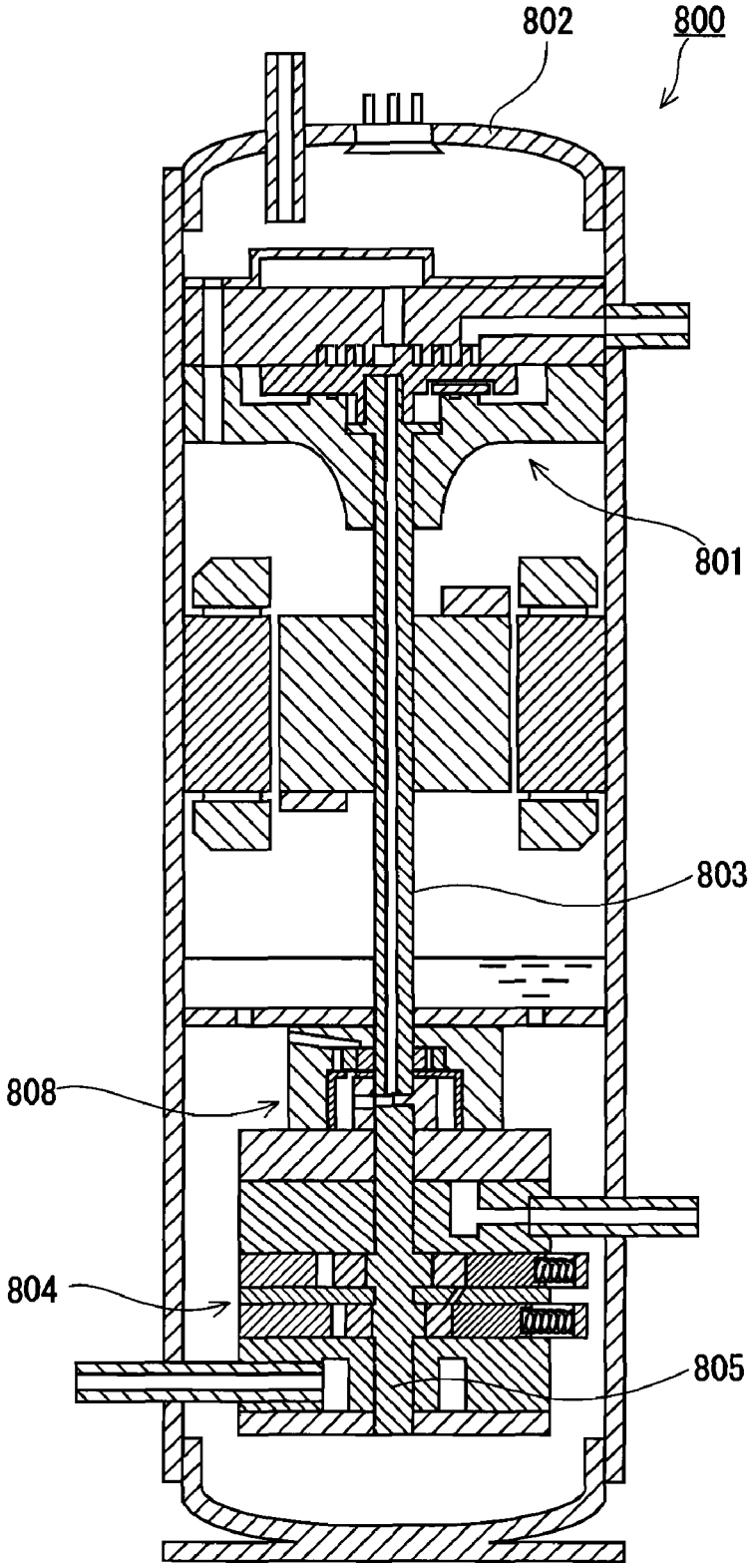
FIG. 10 is a cross-sectional view of a conventional expander-integrated compressor.

FIG. 8 is a cross-sectional view of a fluid machine according to Embodiment 3 of the present invention. The fluid machine 204 can be applied to the refrigeration cycle apparatus 100 (FIG. 1) instead of the fluid machine 101 described in the Embodiment 1.

The fluid machine 204 includes a first compressor 307 and the second compressor 108. The second compressor 108 is the same as that of the Embodiment 1. The first compressor 307 includes the first closed casing 111, the first motor 110, a first compression mechanism 142, a first oil pump 145, a first shaft 150 (with an upper shaft 143 and the lower shaft 113*b*) and the expansion mechanism 104. The first motor 110, the first compression mechanism 142, the first oil pump 145, and the expansion mechanism 104 are arranged in this order from the top with respect to the vertical direction.

The first compression mechanism 142 is a rotary compression mechanism. The first compression mechanism 142 is attached to a lower side of the upper shaft 143. The first motor 110 is attached to an upper side of the upper shaft 143. The expansion mechanism 104 is disposed below the first compression mechanism 142. The upper shaft 143 protrudes below the first compression mechanism 142. The upper shaft 143 and the lower shaft 113*b* are coupled to each other via the coupler 114 disposed in the first oil pump 145.

The oil supply passage 144 is formed in the upper shaft 143. The first oil pump 145 has a suction port 145*a* and an oil chamber 145*b*. The coupler 114 is disposed in the oil chamber 145*b*. The lubricating oil held in the first oil reservoir 112 is guided to the oil supply passage 144 via the suction port 145*a*, the oil chamber 145*b*, and the supply port 114*a* of the coupler 114. The lubricating oil guided to the oil supply passage 144 is supplied to the first compression mechanism 142 and lubricates the interior of the first compression mechanism 142.

The first compression mechanism 142 has a vane 146 and a vane groove 147. The vane 146 slidably is disposed in the vane groove 147. A part of the vane groove 147 is exposed to the first oil reservoir 112, and the lubricating oil held in the first oil reservoir 112 is supplied directly to the vane groove 147.

The first opening 109*a* of the oil passage 109 is located at a height that allows the first opening 109*a* to face the first compression mechanism 142 with respect to the vertical direction. The first compression mechanism 142 has a high temperature when the refrigeration cycle apparatus 100 is being operated, and heats the lubricating oil present in the surrounding space. The flow suppressing member 122 and the spacer 123 are provided between the first compression mechanism 142 and the expansion mechanism 104. This configuration can prevent the low temperature lubricating oil in the surrounding space of the expansion mechanism 104 from moving to the second compressor 108, and prevent the high temperature lubricating oil in the second compressor 108 from moving to the surrounding space of the expansion mechanism 104. These effects are as described in the Embodiment 1.

The lower end of the first opening 109*a* of the oil passage 109 is located higher than the vane 146 and the vane groove 147 with respect to the vertical direction. This positional relationship reduces the possibility that the oil level 112*a* is lowered to a position below the vane 146 and the vane groove 147. Thereby, the shortage of the oil supply to the vane 146 and the vane groove 147 can be prevented, enhancing the reliability of the first compression mechanism 142.

Industrial Applicability

The present invention is useful for a fluid machine including the first compressor with the expansion mechanism for recovering power from the working fluid, and the second compressor combined with the first compressor. The present invention also is useful for a refrigeration cycle apparatus using the fluid machine. The application of the refrigeration cycle apparatus is not limited in any way, and it can be applied, for example, to a water heater, a hot water heating apparatus, and an air conditioner.

The invention claimed is:

1. A fluid machine comprising:

a first compressor having a first closed casing, a first compression mechanism disposed in the first closed casing, an expansion mechanism disposed in the first closed casing in such a manner that the expansion mechanism is located below the first compression mechanism with respect to a vertical direction, and a shaft coupling the first compression mechanism to the expansion mechanism, the first closed casing having a first oil reservoir formed therein in such a manner that a surrounding space of the expansion mechanism is filled with a lubricating oil for the first compression mechanism and the expansion mechanism;

a second compressor having a second closed casing and a second compression mechanism disposed in the second closed casing, the second closed casing having a second oil reservoir formed at a bottom portion thereof in such a manner that the lubricating oil for the second compression mechanism is held therein, and the second compression mechanism being connected in parallel to the first compression mechanism; and an oil passage having, on a side of the first closed casing, an opening located above the expansion mechanism with respect to the vertical direction, the oil passage connecting the first closed casing to the second closed casing so that the lubricating oil can flow between the first oil reservoir and the second oil reservoir.

2. The fluid machine according to claim 1, wherein:

the first compressor further has a flow suppressing member provided in the first oil reservoir so as to suppress a flow of the lubricating oil with respect to the vertical direction; and the opening of the oil passage on the side of the first closed casing is located above the flow suppressing member with respect to the vertical direction.

3. The fluid machine according to claim 2, wherein:

an axial direction of the shaft is parallel to the vertical direction, the flow suppressing member is composed of a plate disposed horizontally in the first oil reservoir; and the opening of the oil passage on the side of the first closed casing, the flow suppressing member, and the expansion mechanism are arranged in this order from a top with respect to the axial direction of the shaft.

4. The fluid machine according to claim 3, wherein:

the first compressor further has a first oil supply mechanism for supplying the lubricating oil held in the first oil reservoir to the first compression mechanism; and the opening of the oil passage on the side of the first closed casing, a suction port of the first oil supply mechanism, and the flow suppressing member are arranged in this order from the top with respect to the axial direction of the shaft.

5. The fluid machine according to claim 1, wherein:

the first compressor further has a first oil supply mechanism for supplying the lubricating oil held in the first oil reservoir to the first compression mechanism; and the opening of the oil passage on the side of the first closed casing is located above a suction port of the first oil supply mechanism with respect to the vertical direction.

6. The fluid machine according to claim 1, wherein:

the second compressor further has a second oil supply mechanism for supplying the lubricating oil held in the second oil reservoir to the second compression mechanism; and another opening of the oil passage on a side of the second closed casing is located above a suction port of the second oil supply mechanism with respect to the vertical direction.

7. The fluid machine according to claim 1, wherein:

the first compressor further has a first motor disposed in the first closed casing to drive the first compression mechanism; and the opening of the oil passage on the side of the first closed casing is located below a rotor of the first motor with respect to the vertical direction.

8. The fluid machine according to claim 1, wherein:

the second compressor further has a second motor disposed in the second closed casing to drive the second compression mechanism: and another opening of the oil passage on a side of the second closed casing is located below a rotor of the second motor with respect to the vertical direction.

9. The fluid machine according to claim 1, wherein:

assuming that the opening of the oil passage on the side of the first closed casing is defined as a first opening and another opening of the oil passage on a side of the second closed casing is defined as a second opening, the first opening is located at a height equal to that of the second opening, or the first opening is located lower than the second opening with respect to the vertical direction, with an undersurface of the first closed casing being used as a reference.

10. The fluid machine according to claim 1, wherein the oil passage is formed of a straight pipe.

11. The fluid machine according to claim 1, wherein:

the oil passage is formed of a U-shaped bent pipe; and the bent pipe is inserted into each of the first closed casing and the second closed casing from the same direction.

12. The fluid machine according to claim 1, further comprising a pressure equalizing passage bringing an internal space of the first closed casing into communication with an internal space of the second closed casing.

13. The fluid machine according to claim 12, wherein:

the first compressor is configured in such a manner that a working fluid compressed by the first compression mechanism is discharged to an outside of the first closed casing via the internal space of the first closed casing;

the second compressor is configured in such a manner that the working fluid compressed by the second compression mechanism is discharged to an outside of the second closed casing via the internal space of the second closed casing; and the pressure equalizing passage is formed of a pipe having, as branched portions, a discharge pipe for guiding the working fluid compressed by the first compression mechanism to the outside of the first closed casing, and a discharge pipe for guiding the working fluid compressed by the second compression mechanism to the outside of the second closed casing.

14. The fluid machine according to claim 12, wherein:

the first compressor further has a first oil supply mechanism for supplying the lubricating oil held in the first oil reservoir to the first compression mechanism;

the second compressor further has a second oil supply mechanism for supplying the lubricating oil held in the second oil reservoir to the second compression mechanism; and a suction port of the first oil supply mechanism is located at a height equal to that of a suction port of the second oil supply mechanism, or a suction port of the first oil supply mechanism is located lower than a suction port of the second oil supply mechanism with respect to the vertical direction, with the undersurface of the first closed casing being used as a reference.

15. The fluid machine according to claim 1, wherein the second compressor further has a bottom raising member for complementing a height of the second closed casing to a height of the first closed casing with respect to the vertical direction.

16. The fluid machine according to claim 1, wherein the first compression mechanism is a scroll compression mechanism and the expansion mechanism is a rotary expansion mechanism.

17. A refrigeration cycle apparatus comprising:

a compressor for compressing a working fluid;

a radiator for cooling the working fluid compressed by the compressor;

an expander for expanding the working fluid cooled by the radiator; and an evaporator for evaporating the working fluid expanded by the expander, wherein the fluid machine according to claim 1 is used as the compressor and the expander.

18. The refrigeration cycle apparatus according to claim 17, wherein the working fluid is carbon dioxide.

* * * * *